US008789609B2

(12) United States Patent
Smith et al.

(10) Patent No.: US 8,789,609 B2
(45) Date of Patent: Jul. 29, 2014

(54) SUBMERSIBLE HYDRAULIC ARTIFICIAL LIFT SYSTEMS AND METHODS OF OPERATING SAME

(76) Inventors: David Randolph Smith, Kilgore, TX (US); Mark Christopher Ventura, Huntington Beach, CA (US)

( * ) Notice: Subject to any disclaimer, the term of this patent is extended or adjusted under 35 U.S.C. 154(b) by 442 days.

(21) Appl. No.: 13/082,240

(22) Filed: Apr. 7, 2011

(65) Prior Publication Data

US 2011/0247831 A1 Oct. 13, 2011

Related U.S. Application Data

(60) Provisional application No. 61/321,605, filed on Apr. 7, 2010.

(51) Int. Cl.
*E21B 43/00* (2006.01)

(52) U.S. Cl.
USPC ..... 166/372; 166/68

(58) Field of Classification Search
USPC ..... 166/369, 372, 263, 52, 68, 68.5
See application file for complete search history.

(56) References Cited

U.S. PATENT DOCUMENTS

| | | | | |
|---|---|---|---|---|
| 5,845,709 | A * | 12/1998 | Mack et al. | 166/302 |
| 6,082,452 | A * | 7/2000 | Shaw et al. | 166/105.5 |
| 6,138,758 | A * | 10/2000 | Shaw et al. | 166/265 |
| 6,216,784 | B1 | 4/2001 | Harrell | |
| 7,063,161 | B2 * | 6/2006 | Butler et al. | 166/372 |
| 7,249,634 | B2 * | 7/2007 | de Albuquerque et al. | 166/335 |
| 7,594,543 | B2 * | 9/2009 | Goncalves et al. | 166/372 |
| 2005/0249613 | A1 | 11/2005 | Jordan et al. | |
| 2006/0213666 | A1 | 9/2006 | Crawford | |
| 2011/0056699 | A1 * | 3/2011 | Bjoroy et al. | 166/369 |
| 2011/0180267 | A1 * | 7/2011 | Wildman et al. | 166/372 |

OTHER PUBLICATIONS

International Search Report for PCT Application No. PCT/US2011/031609, mailed Jun. 9, 2011.

* cited by examiner

*Primary Examiner* — Kenneth L Thompson
*Assistant Examiner* — Michael Wills, III
(74) *Attorney, Agent, or Firm* — Fulbright & Jaworski LLP

(57) ABSTRACT

The present invention is directed to methods for extracting fluids from oil and gas wells. More specifically, it is directed toward methods and apparatuses to power and control down hole hydraulic devices using subterranean centrifugal pumps. This invention represents a vast improvement over current hydraulic artificial lift systems. This invention provides for safe, efficient, and increased fluid recovery of oil and gas reserves from subterranean reservoirs in all types of wells, including deviated and horizontal wells.

22 Claims, 8 Drawing Sheets

SUBMERSIBLE HYDRAULIC ARTIFICIAL LIFT SYSTEMS AND METHODS OF OPERATING SAME

CROSS-REFERENCE TO RELATED APPLICATIONS

The present application claims priority to U.S. Application No. 61/321,605, which was filed on Apr. 7, 2010, entitled METHOD AND APPARATUS TO OPERATE AND CONTROL SUBMERSIBLE HYDRAULIC MOTORS, the disclosure of which is incorporated by reference.

TECHNICAL FIELD

The present disclosure is directed to methods and apparatus to extract fluids from subterranean reservoirs, particularly oil and gas reservoirs. More specifically, this disclosure provides methods and apparatuses to increase the recovery of fluid reserves, such as oil and gas, from subterranean reservoirs using an improved hydraulic system to power subterranean devices.

BACKGROUND OF THE INVENTION

When a fluid, such as oil and natural gas, is being produced from a subterranean reservoir, the reservoir may not have sufficient energy, or the reservoir strata may have insufficient fluid conductivity, to eject fluids to the surface at a commercial fluid flow rates. A conventional method to recover fluids from a reservoir that has inadequate fluid conductivity is hydraulic fracturing. This hydraulic fracture treatment often allows reservoir fluids to be recovered at commercial rates. This benefit, however, is typically only temporary because fluid production to the surface will usually decline as fluids are extracted from the reservoir. In the case of a reservoir producing natural gas, the reservoir energy is normally depleted until it no longer ejects all the fluids out of the well.

As the fluids begin to accumulate in the well due to decreased flow conductivity, this accumulation further causes a hydrostatic fluid pressure that is exerted against the pressure of the subterranean reservoir, thereby reducing the flow of fluid to the surface. With time, this condition will eventually cause the well to stop producing fluid to the surface.

Another known method to increase fluid production is to insert a smaller conduit known as a velocity string into the well casing, to allow fluids to rise to the surface at a higher velocity. Higher fluid velocity has been found to increase the amount of fluid that can be lifted out of a well. Generally, both these methods may be combined to improve production of a low fluid conductivity reservoir. For instance, a reservoir may be hydraulically fractured then a velocity string may be inserted coaxially inside the casing to produce additional well fluids up the velocity string.

As mentioned above, increased fluid production from a hydraulically fractured well having a velocity string is not maintained indefinitely. Instead, as the reservoir pressure continues to be depleted during fluid extraction, the fluid velocity in the coaxially inserted velocity string becomes insufficient to lift the well fluids to the surface at a commercial production rate. Consequently, fluids begin to accumulate in the well and once again exert a hydrostatic pressure against the reservoir. While, additional smaller velocity strings can be coaxially inserted to increase fluid velocity, this method has its drawbacks. For instance, each new smaller velocity string reduces the fluid flow rates to the surface due to the increasing fluid friction in the velocity string as the diameter decreases.

Further, inserting additional velocity strings does not address the decreasing reservoir energy as a reservoir is depleted of fluids, where the reservoir energy continues to decrease until it is insufficient to lift fluids to the surface at commercial rates.

Moreover, inserting additional velocity strings is inconvenient and not commercially expedient because to use the well configuration that was lastly deployed rather than extracting the final well configuration with an expensive rig intervention only to deploy some other configuration for further extracting well fluids at the current conditions. At this point in the life of a well generally known method of artificial lift is used to further extract fluid from the reservoir without substantially changing the well configuration, i.e., without pulling the last velocity string that was disposed in the well.

The known artificial lift pumping methods of the prior art were originally developed to extract oil and water from subterranean reservoirs. As such, these known artificial lift methods may not be best suited for extracting fluids from gas wells. There is still a need for applicable artificial lift means to operate in natural gas wells to assist in removing the fluids from such wells as the reservoir energy and correspondingly fluid flow velocities decrease to allow for commercial quantities of natural gas to be produced. Moreover, as natural gas wells are constructed deeper and deeper with more well bore deviation (indeed even horizontal orientations in such well bores are used through subterranean reservoirs), the need for a suitable means to lift fluids from the gas wells has increased.

There are various conventional artificial lift devices and methods, particularly used in the oil and gas industry, including gas lift, electrical submersible centrifugal pump systems, surface beam pumps with down hole traveling valves, surface electrical motors rotating rods from surface and attached to a well progressive cavity pump, hydraulic jet pumps, hydraulic piston pumps.

Also, the conventional hydraulic submersible artificial lift methods often involve the use of positive displacement piston pumps located at the surface to power the down hole hydraulic motors, engines, and pumps. An example of such pumps is disclosed in U.S. Pat. No. 2,081,221 to Clarence J. Coberly. These conventional systems of hydraulically lifting fluids from oil and gas wells introduce significant environmental hazards because they place high pressure hydraulic positive displacement piston pump systems at the surface.

It is further known to those familiar with producing oil and gas wells with hydraulic pumping systems that the use of water as a power fluid is limited in cold climates. The power water fluid is often heated or treated with freeze depressant chemicals to avoid freezing. This has many disadvantages, including extra energy use and the possibility of introducing hazardous chemicals into the environment.

The field of dewatering gas wells or as it is often known in the oil and gas industry as artificial lifting gas wells, is reluctant to adopt the current methods of hydraulic powered submersible hydraulic motors, engines, compressors, and pumps as most are currently powered by surface positive displacement piston pump systems. These conventional art uses of surface located positive displacement systems are dangerous and often outlawed by city ordinances for many reasons. In particular, there are likely risks associated with these systems, such as over pressurization of the surface equipment when a well hydraulic fluid system plugs, or a surface valve closes on the positive displacement tri-plex pumps discharge side, which causes a high pressure release of hydraulic power fluid.

Further, the conventional positive displacement pumps placed at the surface have large dimensions that cannot easily be accommodated in a well conduit and hence are located on the surface of the earth or at best on small skids with fluid containments beneath them. This configuration also introduces risks both at the surface environment and into a hydraulic power system, as an inadvertent closure of a valve, or the plugging of a valve, can cause a rapid pressure rise in the positive displacement pumps discharge often resulting in a catastrophic rupture and leak of the hydraulic power system. This catastrophic pressure rupture causes oil spills, fires, pollution, and danger to humans. Additionally, the conventional hydraulic power pumps surface arrangements have packing, and oil lubricants in their power ends that can leak and spill oil on the earth's surface. Hence the conventional hydraulic pumping system for lifting fluids from wells have many drawbacks including continual and frequent oil changes, and pump maintenance further introducing the opportunity to have an oil spill at the surface.

Additional drawbacks include a large surface footprint, which makes the conventional systems difficult to house or encapsulate to contain leaks from the pump system. What is needed is a method to hydraulically power submersible hydraulic motors with a hydraulic power systems that can be disposed below the surface in a containment means to avoid oil spills, and dangers if such a high pressure pump catastrophically fails.

In view of the disadvantages of the current system, there is a need for a hydraulic power pumping system that does not involve positive displacement pumps located at the surface to address the drawbacks of current systems such as frequent lubricant changes, lubricant additions; catastrophic conduit failure caused by valve closure or conduit plugging; and heating or treating operating fluid functional in cold climates.

BRIEF SUMMARY OF THE INVENTION

To meet the needs discussed above and address the disadvantages of conventional systems, the present disclosure provides a submersible hydraulic lift system comprising a first submersible pump assembly and a first submersible hydraulic engine component connected to a first submersible hydraulic transducer component. At least a portion of said first submersible pump assembly is located below the surface. Further, at least a portion of said first submersible hydraulic engine is located below the surface. The first submersible hydraulic transducer component has a hydraulic fluid connection with one or more fluids of a subterranean reservoir. The submersible hydraulic lift system further comprises a first fluid path that hydraulically connects the first submersible pump assembly with the first submersible engine component. The first submersible pump assembly is configured to hydraulically drive the first submersible hydraulic engine component by transferring power liquid from the first submersible pump assembly to the first submersible hydraulic engine component through the first fluid path.

In one embodiment, the system further comprises a second fluid path that hydraulically connects an output of the first fluid transducer component with the surface. The hydraulically driven first submersible engine component is configured to drive the connected first submersible hydraulic transducer component. The driven first submersible hydraulic transducer component is configured to extract the one or more reservoir fluids and discharge the one or more reservoir fluids into the second fluid path.

In another embodiment, the first submersible pump assembly comprises a submersible electrical motor component, a submersible pump component, and a pump intake component, where the submersible pump intake component is connected to said electrical motor component and said submersible pump component and where the submersible electrical motor component is connected to said submersible pump component where a rotation of said submersible electrical motor component results in the rotation of said submersible pump component.

In yet another embodiment, the submersible pump component comprises a centrifugal pump. In another embodiment, the fluid transducer comprises a submersible hydraulic pump. Alternatively, the fluid transducer comprises a submersible hydraulic compressor. In another embodiment, the system further comprises a frequency drive machine configured to control the revolutions per minute of said submersible electrical motor component.

In another embodiment, the system further comprises a commercialization fluid path, said commercialization fluid path hydraulically connecting said second fluid path with a commercialization point.

In another embodiment, a portion of said first submersible pump assembly is disposed in a first casing of a first well and wherein a portion of said first submersible hydraulic engine component and a portion of said first submersible hydraulic transducer component are disposed in a second casing of a second well. In this embodiment, the system further comprises a second submersible hydraulic engine component connected to a second submersible hydraulic transducer component. At least a portion of said second submersible hydraulic engine is located below the surface, said submersible hydraulic transducer component having a hydraulic fluid connection with one or more fluids of said subterranean reservoir. The system further includes a third fluid path, said fourth fluid path hydraulically connecting said first submersible pump assembly with said second submersible engine component. The first submersible pump assembly is configured to hydraulically drive said second submersible hydraulic engine component by transferring power liquid from said first submersible pump assembly to said second submersible hydraulic engine component through said third fluid path. The system further includes a fourth fluid path, said fourth fluid path hydraulically connecting an output of said second fluid transducer component with the surface. The hydraulically driven second submersible engine component is configured to drive said connected second submersible hydraulic transducer component. The driven second submersible hydraulic transducer component is configured to extract said one or more reservoir fluids and discharge said one or more reservoir fluids into said second fluid path.

In another embodiment, the system further comprises an acoustic monitoring component. The acoustic monitoring component comprises at least one surface acoustic sensor connected to said first fluid path and to a controller component, said controller component connected to said a power source of said first submersible pump assembly. The at least one surface acoustic sensor is configured to receive one or more acoustic signals generated by said first submersible hydraulic engine and transferred through said first fluid path. The at least one surface acoustic sensor is also configured to transmit to said surface controller data corresponding to said received one or more acoustic signals. The controller component is configured to manage at least fluid discharge pressure and rate of said first submersible hydraulic engine by controlling said power source. In one embodiment, the data is transmitted wirelessly. Alternatively, the data is transmitted by a submersible acoustic signal transmission system connected to said at least one surface acoustic sensor and said controller component.

In another embodiment, the system of claim 1 wherein said second fluid path comprises a subterranean conduit. In yet another embodiment, the power fluid is selected from a group consisting of propane, ammonia, water, oil, and any combination thereof.

According to another aspect of the present disclosure, there is provided a method for operating a submersible hydraulic engine comprising the steps: operating a first submersible pump assembly, wherein at least a portion of said first submersible pump assembly is located below the surface and hydraulically driving a first submersible hydraulic engine component by said operation of said first submersible pump assembly, wherein at least a portion of said first submersible hydraulic engine is located below the surface. The step of hydraulically driving comprises transferring of power fluid by said first submersible pump assembly from said first submersible pump assembly to said first submersible hydraulic engine component through a first fluid path, said first fluid path hydraulically connecting said first submersible pump assembly with said first submersible engine component In one embodiment, the method further comprises driving a first submersible hydraulic transducer component connected to said first submersible hydraulic engine component by said hydraulically driving step. The first submersible hydraulic transducer component has a hydraulic fluid connection with one or more fluids of a subterranean reservoir. The method further comprises discharging said power fluid into a second fluid path, said second fluid path hydraulically connecting an output of said first fluid transducer component with the surface; extracting said one or more reservoir fluids by said first submersible fluid transducer; and discharging said one or more reservoir fluids by said first submersible fluid transducer into said second fluid path, wherein said power fluid mixes with said one or more reservoir fluids.

In another embodiment, the method further comprises collecting said fluid mixture at the surface from an output of said second fluid path; and separating from said collected fluid mixture said one or more reservoir fluids by a separator component. In yet another embodiment, the method further comprises transferring said separated one or more reservoir fluids to a commercialization point through a commercialization fluid path, said commercialization fluid path hydraulically connecting said second fluid path with a commercialization point.

In another embodiment, the method further comprises driving a first submersible hydraulic transducer component connected to said first submersible hydraulic engine component by said hydraulically driving step. The first submersible hydraulic transducer component having a hydraulic fluid connection with one or more fluids of a subterranean reservoir. The method further comprises discharging said power fluid into a return fluid path, said return fluid path hydraulically connecting an output of said first fluid transducer component with an input of said first submersible pump assembly; extracting said one or more reservoir fluids by said first submersible fluid transducer; and discharging said one or more reservoir fluids by said first submersible fluid transducer into said second fluid path, wherein said power fluid mixes with said one or more reservoir fluids and wherein at least a portion of said power fluid comprises a portion of said fluid mixture.

In another embodiment, the method further comprises collecting said fluid mixture at the surface from an output of a collection fluid path, said collection fluid path hydraulically connecting an output of said return fluid path with an input of a separator component; and separating from said collected fluid mixture said one or more reservoir fluids by said separator component.

In another embodiment, the method further comprises monitoring one or more acoustic signals generated by said first submersible hydraulic engine with at least one surface acoustic sensor connected to said first fluid path and to a controller component. The controller component is also connected to said power source of said first submersible pump assembly. The method further comprises managing at least fluid discharge pressure and rate of said first submersible hydraulic engine by controlling said power source.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1A:
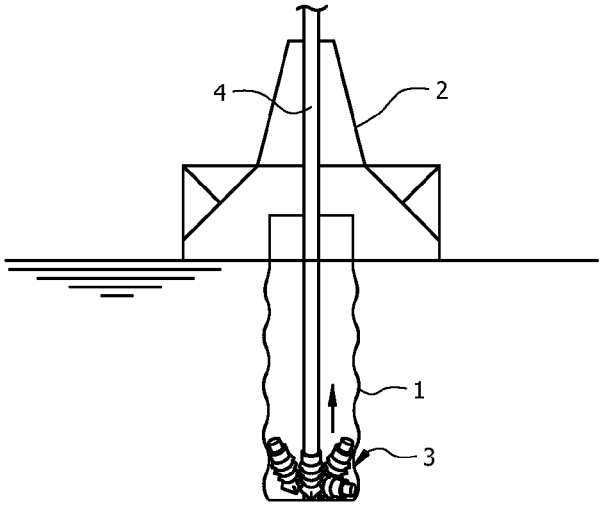
FIG. 1 illustrates general well construction and production enhancement phases during the life of a well.
Figure 1B:
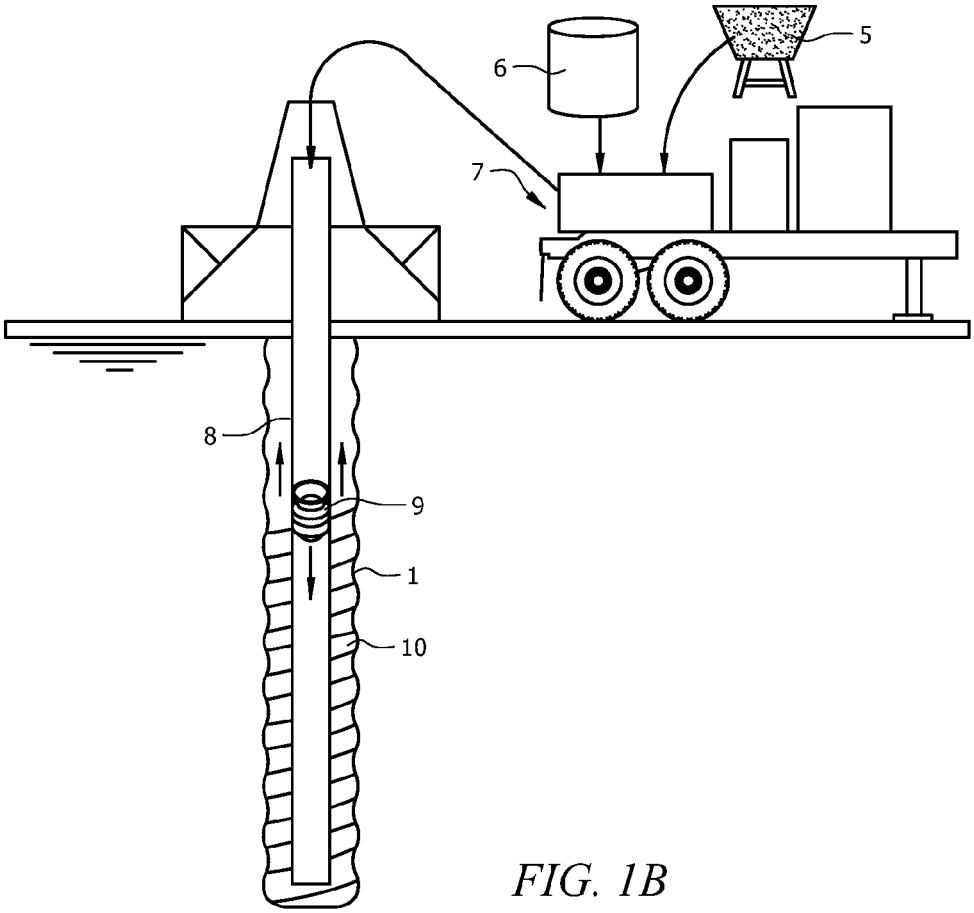

As used herein, "a" or "an" means one or more. Unless otherwise indicated, the singular contains the plural and the plural contains the singular. Where the disclosure refers to "perforations" it should be understood to mean "one or more perforations".

As used herein, "surface" refers to locations at or above the surface of the earth.

Referring to FIG. 1, sequential phases of an embodiment of the well construction and production enhancement process of the present disclosure are shown. During the first phase illustrated by FIG. 1A, well bore 1 is drilled using a drilling rig 2, which has a drill pipe 4 attached. Drill pipe 4 has drilling bits 3 attached to its distal end that allows for drilling of well bore 1. After the well bore 1 is drilled to a desired depth and diameter, a casing is placed within the well bore 1. The drilling equipment and method to drill well bore 1 are known to those skilled in the art. Referring to FIG. 1B, the next phase involves the wellbore 1 being grouted with cement from a cement bin 5, preferably pneumatic, where the cement is mixed with water from a source tank 6 through a cement pump unit 7 forming a cement grout slurry. This slurry is transferred through the well casing 8 down into the well. The slurry is displaced with water from the source tank 6 with a cement plug 9, and this displacement forces the cement grout out of the internal diameter of the casing 8 and into the annular space 10 formed by the outer diameter of casing 8 and the well bore 1. Again, the equipment used to install casing 8 is known to one of ordinary skill in the art.

Figure 1C:
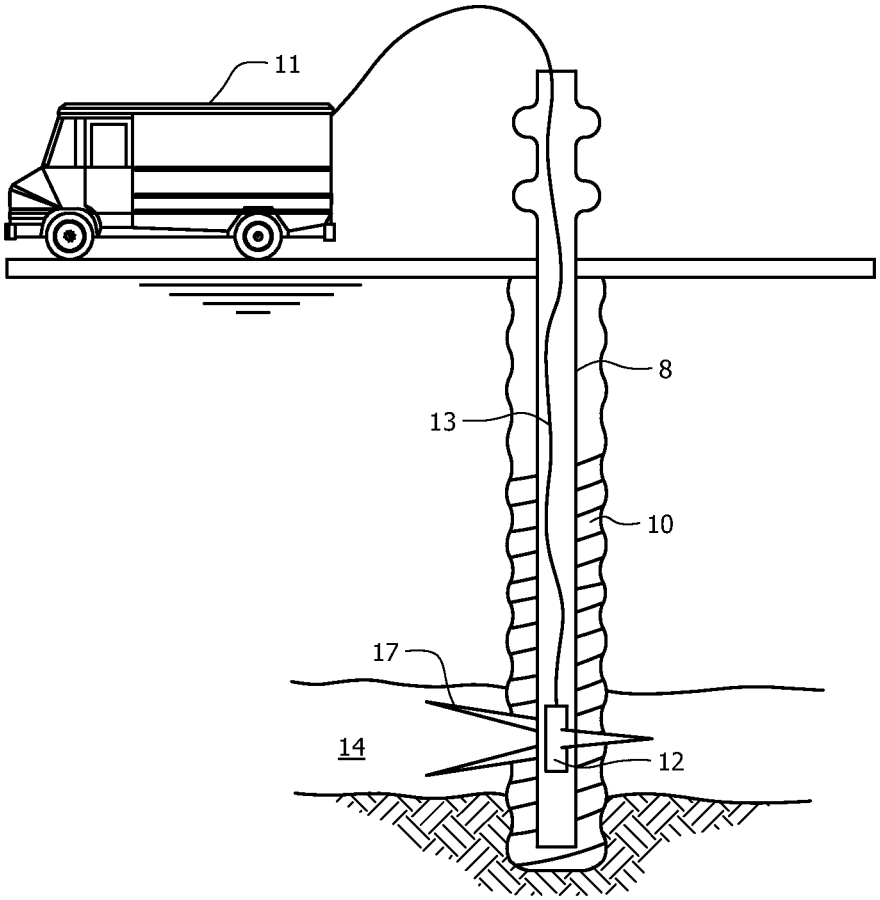
Figure 1D:
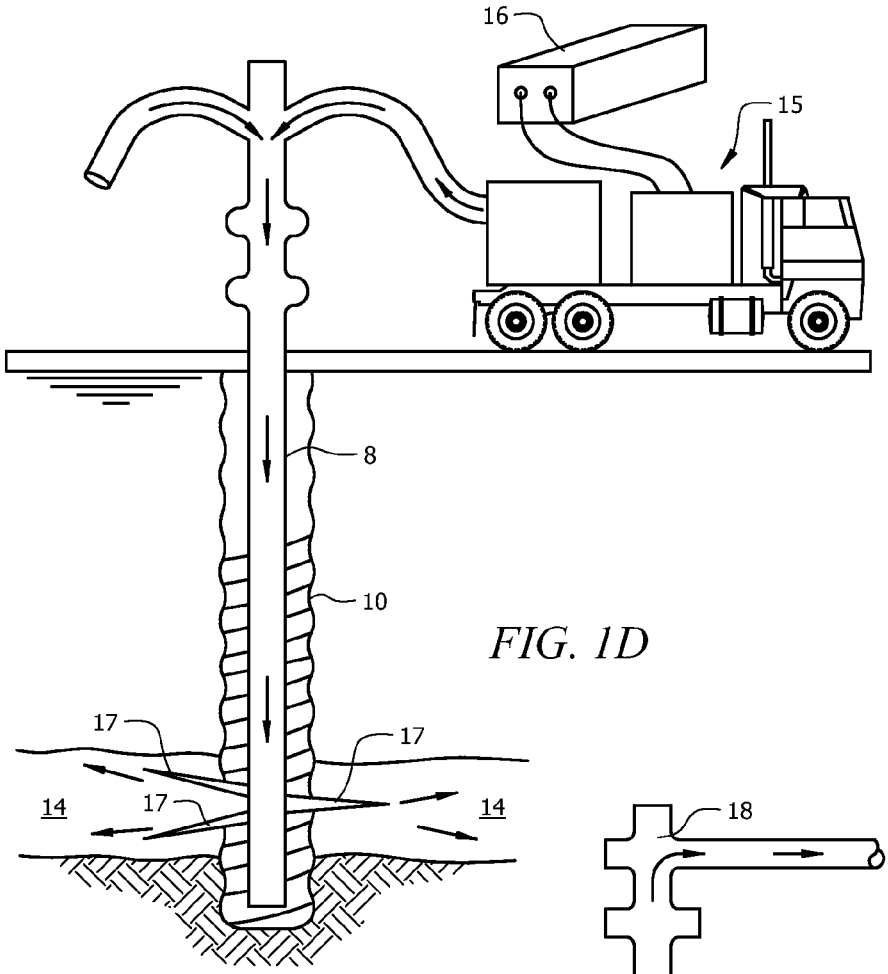
Figure 1E:
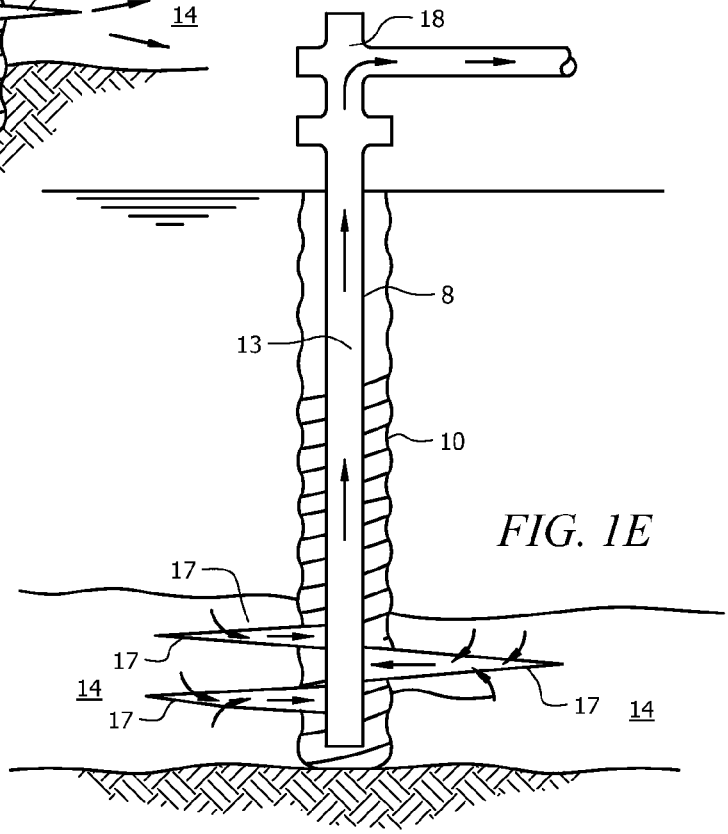
Figure 1F:
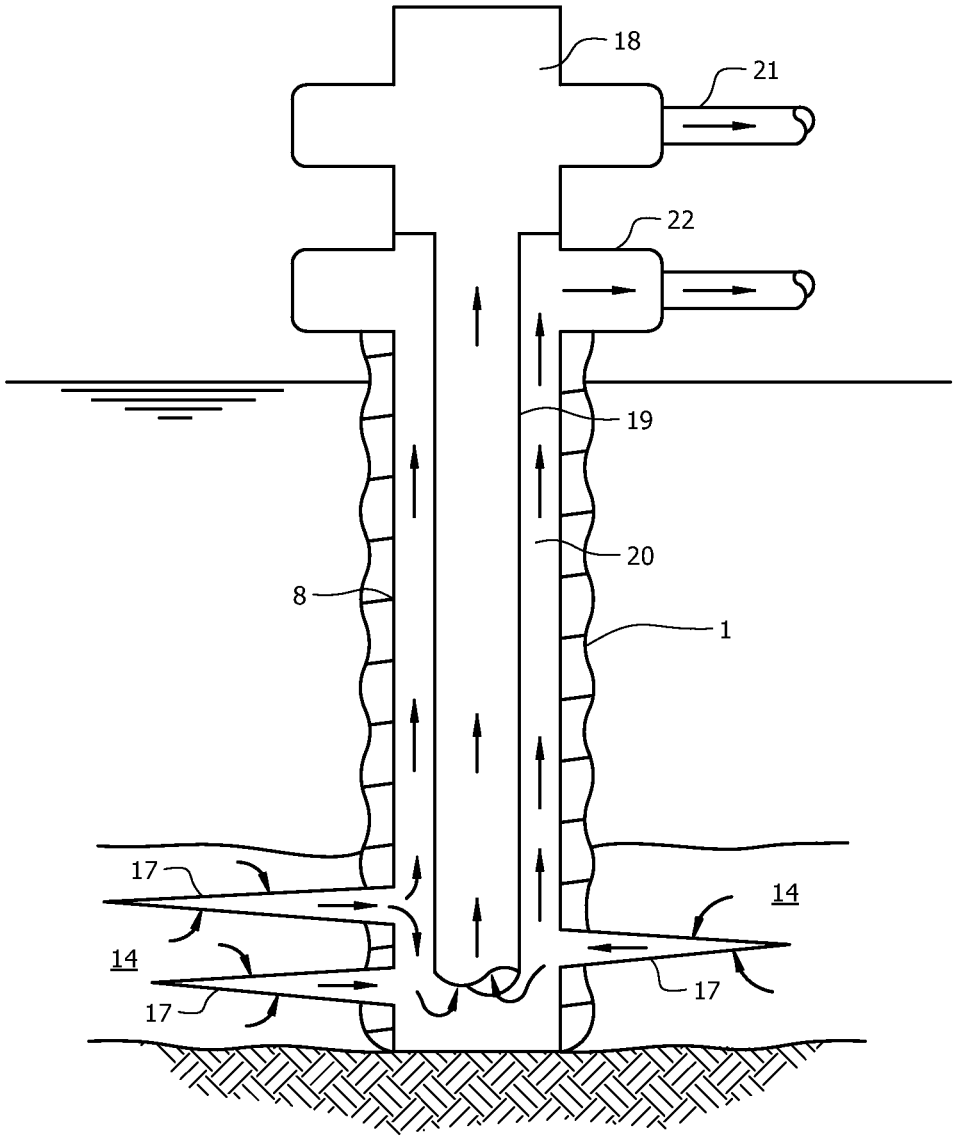

Referring to FIG. 1C, the next phase of the well construction process involves perforation, where a perforating truck 11 deploys a perforating gun assembly 12, which is on wire line 13, into the well casing 8. The perforating gun assembly 12 forms a fluid flow path between the inside of the casing 8 and the subterranean reservoir 14 by creating perforations 17 through the well casing 8 and the cement grout located in the annular space 10. Referring to FIG. 1D, the reservoir 14 is hydraulically fractured by a fluid that is pumped from a surface frac tank 16 through at least one surface pumping unit 15 down the casing 8 through perforations 17. Referring to FIG. 1E, after the hydraulic fracturing treatment, fluids usually flow from the reservoir 14 through the perforations 17 up the casing 8 through the well head 18 to the surface. Referring to FIG. 1F, the well of well bore 1 with a second well conduit 19 that is inserted coaxially within the casing 8. The second well conduit 19 is hung off from the well head 18, which allows reservoir fluids to flow from reservoir 14 through perforations 17 and up both the internal diameter of the second well conduit 19 to the surface and the annular space 20 formed by the outer diameter of the second well conduit 19 and the internal diameter of casing 8. The output of well fluids flowing up the internal diameter of the second well conduit 19 is through port 21 while the output of well fluids flowing up the annular space 20 is through port 22. FIGS. 1A-1F generally illustrate the process of drilling and establishing a well bore. According to another aspect of the present disclosure, other known means of drilling and installing a well can be used. Also, the hydraulic lift system of the present disclosure is also applicable to horizontal or deviated wells.

Figure 2:
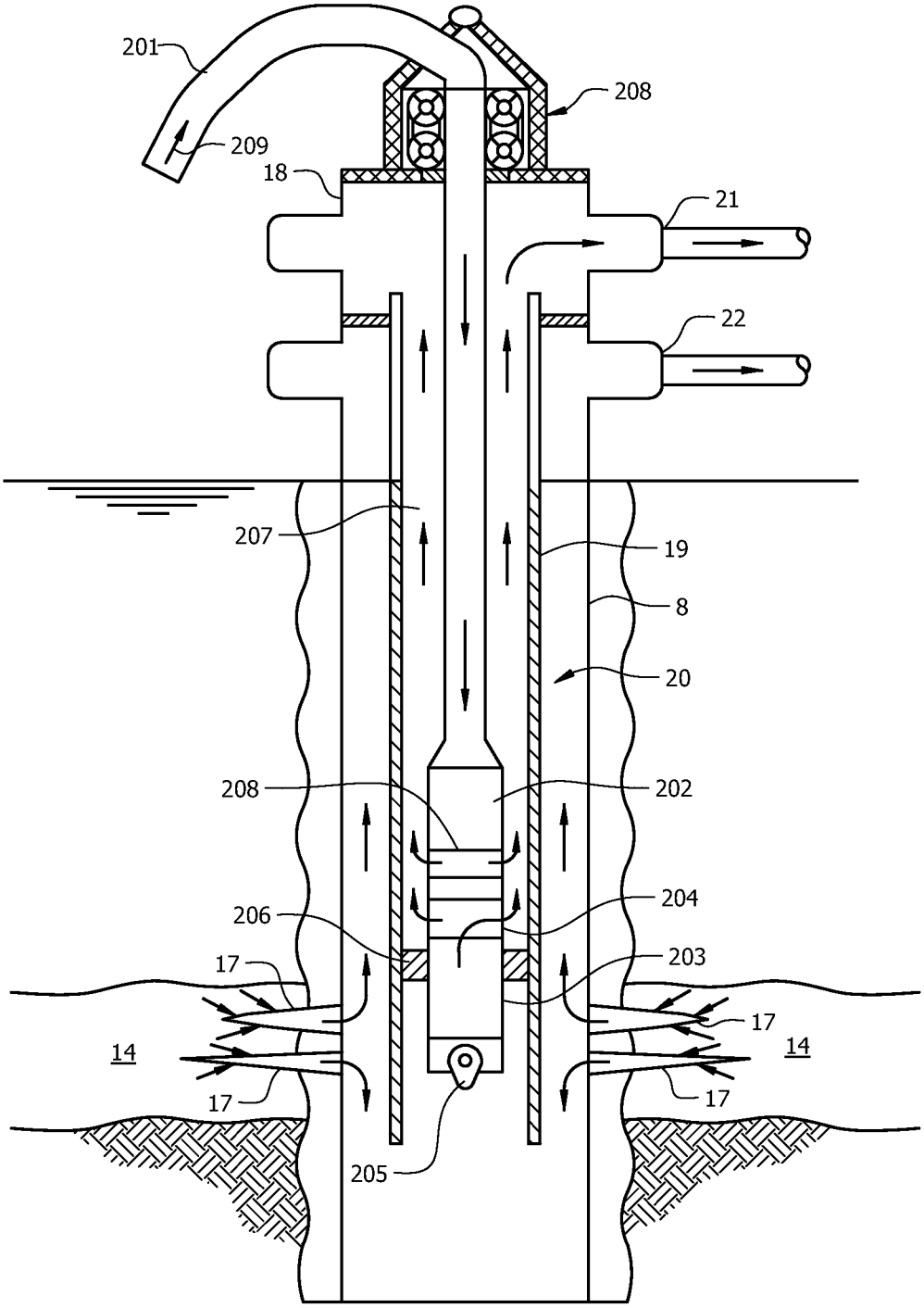
FIG. 2 illustrates a general final well configuration of the fluid production process.

Referring to FIG. 2, the phase subsequent to the phase in FIG. 1F in well construction is illustrated. In FIG. 2, a third conduit of continuous tubing 201 is inserted through the well head 18 so that it is placed coaxially inside the second conduit 19. FIG. 2 further illustrates a hydraulic motor 202 disposed in the second tubing 19 and attached to the distal end of the continuous tubing 201. Also shown in FIG. 2 is a fluid transducer device 203 attached to the hydraulic motor 202. The discharge 204 of the fluid transducer 203 is separated from the intake 205 of the fluid transducer 203 by a sealing means 206 located inside the second tubing 19. One example of such a sealing means is a series of elastomeric rings located on the outer diameter of pump body 203 where the elastomeric rings seal into a corresponding polished bore receptacle means inside the second tubular conduit 19. Another example of such sealing means includes sealing the metallic outer surface of the pump 203 that is engaged with sealing means 206 where sealing means 206 can be a metal receptacle, preferably tapered. The seal is such that the outer metallic diameter of the pump 203 forms a metal to metal seal with the tapered metal receptacle 206. Other sealing means known in the art are also applicable and can be used with the hydraulic lift system of the present disclosure.

FIG. 2 further illustrates fluid flowing from the reservoir 14 through perforations 17 into the well casing 8 into the intake 205 of the fluid transducer 203 and transported through the fluid transducer 203 and through the discharge 204 of the fluid transducer 203 into the annular fluid flow path 207, which is formed between the outer diameter of the continuous tube 201 and the internal diameter of the second well conduit 19. The well fluid is further transported to the surface through port 21 of the well head 18 at the surface. The configuration of FIG. 2 allows fluids to simultaneously flow from the reservoir 14 through the perforations 17 into the casing 8 and up the annular space 20 through port 22 of the well head 18 located at the surface. FIG. 2 further depicts fluid 209 being transduced down from the surface through the continuous tubing 201 through the hydraulic motor 202 and exhausted out of the motor 202 at the motor discharge 208 where fluid 209 mixes with produced well fluids in the annular space 207. The mixture of fluid 209 and well fluid is produced to the surface through port 21 of well head 18. A tubing injector device 210 may be used to insert the continuous tubing 201 through the well head 18 coaxially through the second tubing 19 and landing the fluid transducer 203 into a sealing means 206. One example of the tubing injector device 210 is a hydraulic injector head, which is often used with coiled tubing. Other similar devices known to one of ordinary skill in the art to insert continuous tubing 201 as described can be used.

The submersible hydraulic motor or hydraulic engine 202 used to lift well fluids from reservoirs may be connected to hydraulic jet pumps and hydraulic piston engines, hydraulic motors, and hydraulic piston pumps like those described in U.S. Pat. No. 1,577,971 to Ira B. Humphreys, the disclosure of which is incorporated by reference. In other embodiments, submersible hydraulic fluid transducer 203 may include those described in U.S. Pat. No. 2,081,220 to Clarence J. Coberly, the disclosure of which is incorporated by reference.

The fluid 209 may include water and/or chemicals suitable to reduce friction and wear in the system as well as chemicals suitable to treat corrosion and scale formation. Examples of the fluid include propane, ammonia, water, oil, or any combination thereof. In one embodiment, the fluid transducer 203 is a pump, preferably submersible. In another embodiment, the fluid transducer 203 is a compressor, preferably submersible.

Figure 3:
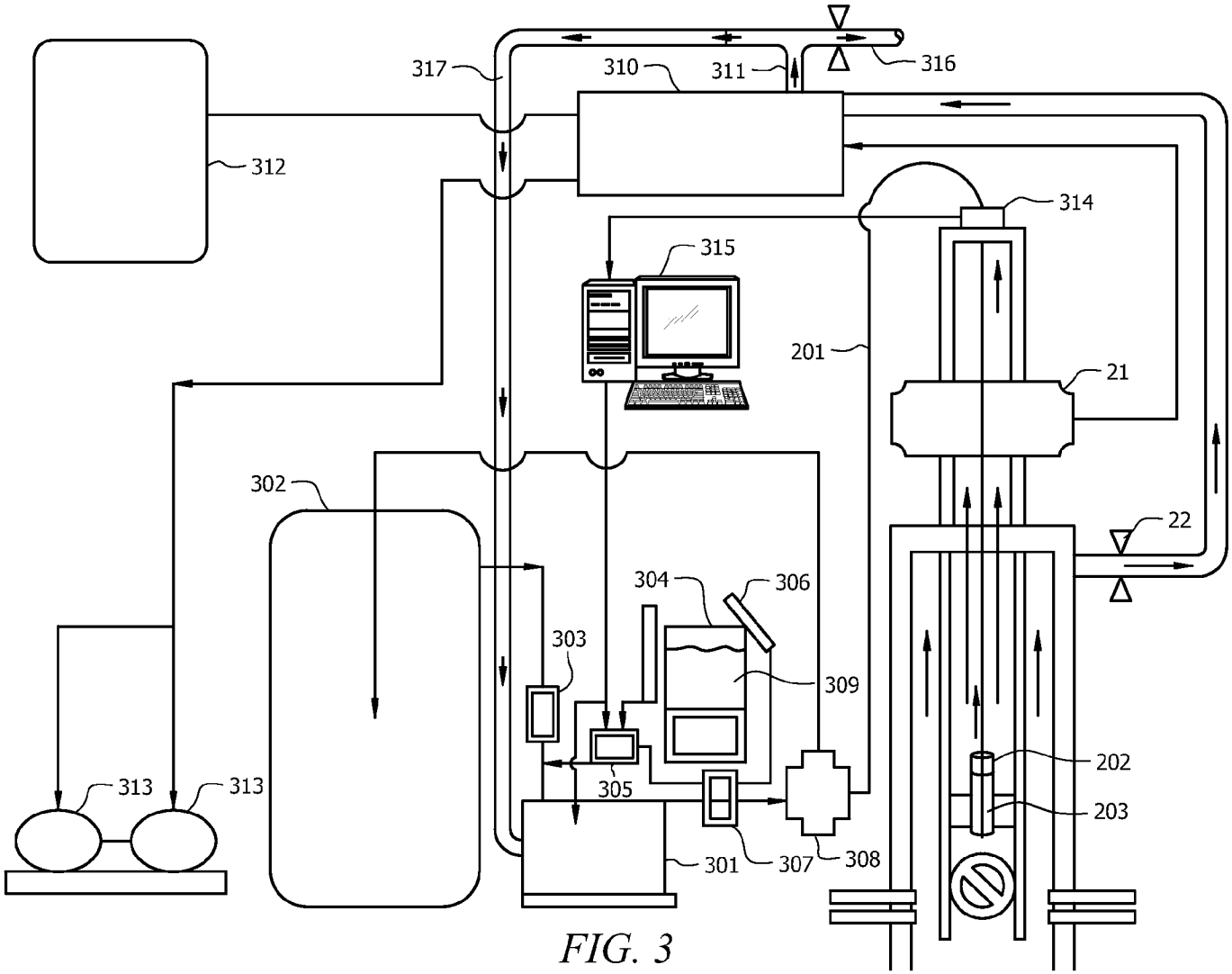
FIG. 3 shows a general configuration of surface equipment used during the final well configuration in the fluid production process.

FIG. 3 illustrates one configuration of the relationship between the final sequential phase of the well depletion method illustrated in FIG. 2 and a hydraulic power fluid system. In FIG. 3, a surface pump 301, this is on a prime mover skid. The surface pump 301 receives fluid from a source tank 302, where the fluid passes through a fluid filter 303. The surface pump 301 also receives a second fluid 309 from a second source tank 304. Fluid 309 may be delivered to surface pump 301 by an injection pump 305, which may be powered, for example, by a solar panel 306. In other embodiments, the injection pump may be powered by other means such as battery or electricity from an outlet. The combined fluid of the fluid from tank 302 and fluid 309 becomes fluid 209, which is then pumped from the surface pump 301 through a filter 307 through a control valve 308 where fluid is allowed to flow either into the continuous tubing 201 or back to the surface tank 302. FIG. 3 further illustrates well fluids being produced through port 22 into a surface separator 310 where the fluids, such as gases, from the well are separated and the desired well fluid is transferred to another location through line 311. The separator 310 further separates the hydrocarbons from water and the hydrocarbons are flowed to tank 312 and the water portion is transferred to a series of large filters 313. The filtered water is then transferred to the tank 302.

In general, FIG. 3 illustrate the well fluid being discharged from the subterranean fluid transducer 203 and the exhaust of the submersible hydraulic motor 202 flowing to the surface through port 21 of the well head 18 into the separator 310. The fluids can be separated into gas, water, and hydrocarbon streams in the separator 310. The hydrocarbon stream is then directed into the tank 312, the water stream is directed into the filters 313 thereafter into the surface tank 302, and the gas is directed to line 311.

FIG. 3 further illustrates the use of an acoustic sensor device in the hydraulically powered artificial lift system described by the present disclosure. The acoustic sensor device allows the system to be operated within the desired parameters, thereby controlling any over pressurization by, or damages to, the system.

In particular, FIG. 3 depicts an acoustic sensing device 314 receiving acoustic signals from the continuous tube 201. The acoustic signals are generated by the mechanical piston reciprocation of the submersible fluid transducer 203 and the submersible hydraulic motor 202. The acoustic sensor 314 transmits a signal to a surface controller 315 that controls the injection pump 305 and the surface pump 301. In one embodiment, the surface pump is preferably powered by a gas supply brought by gas line 317. The gas comes from a portion of the gas supplied by the separator 310, which also sends gas to 316. In another embodiment, controller 315 may be a computer device operable to process the data sent from the acoustic sensor 315 and control the injection pump 305 and surface pump 301.

With regard to acoustic sensors devices, existing electrical acoustic sensors are broadly defined by one of three types: (1) microphones mounted on an acoustic sensors diaphragm, (2) piezo-electric sensors mounted on, or physically connected to, the acoustic sensors diaphragm, and (3) capacitive acoustic sensors. The application of any of the three broad classes of acoustic sensors as well as other acoustic sensing means is within the scope of the embodiments of the present disclosure. According to one aspect, the acoustic energy is transmitted from the submersible hydraulic motor and submersible fluid transducer up the continuous tube 201 of FIG. 2 or 3 to the acoustic sensor 314, where the acoustic sensor 314 is engaged with the continuous conduit 201.

Generally, the acoustical vibration received by the acoustic sensor 314 is converted into an electrical signal through a variety of methods known to those familiar with hydrophones and microphones using for example piezoelectric sensors, microphones, or capacitive acoustic sensors. This electrical signal is then transferred to the controller 315 of FIG. 3 wherein the electrical signal is evaluated and compared to acoustical frequencies and pulses of the submersible hydraulic motor and fluid transducer that are stored in controller 315 or provided to controller 315. The controller algorithms are then used to increase or decrease the power operating the surface pump 301 and the injection pump 304 of FIG. 3. This, in turn, controls the down hole hydraulic motor 202 and fluid transducer 203.

According to one aspect of the present disclosure, the controller 315 preferably will have pre-set values, stored or provided to it, that will allow for the maximum and minimum frequencies of acoustic pulses coming from the submersible hydraulic motor 202 and submersible fluid transducer 203. The controller 315 will allow the surface pump 301 to discharge fluids into the continuous tube 201 of FIG. 3 between these pre-set maximum and minimum frequency values. If for example the frequency of the acoustic pulses received by the acoustic sensor 314 exceeds the maximum allowable frequency, the controller 315 can send an electrical signal to solenoids that will close the gas flow from gas line 317 into the surface pump 301. The solenoids can also disconnect the power to the injection pump 305. The controller 315 may be set to keep the surface pump 301 and injection pump 305 off for a pre-set period of time before the surface pump 301 and injection pump 305 are restarted. Likewise, the controller 215 can be used as a timer to turn off the surface pump 301 and injection pump 305 for a period of time each day.

Figure 4:
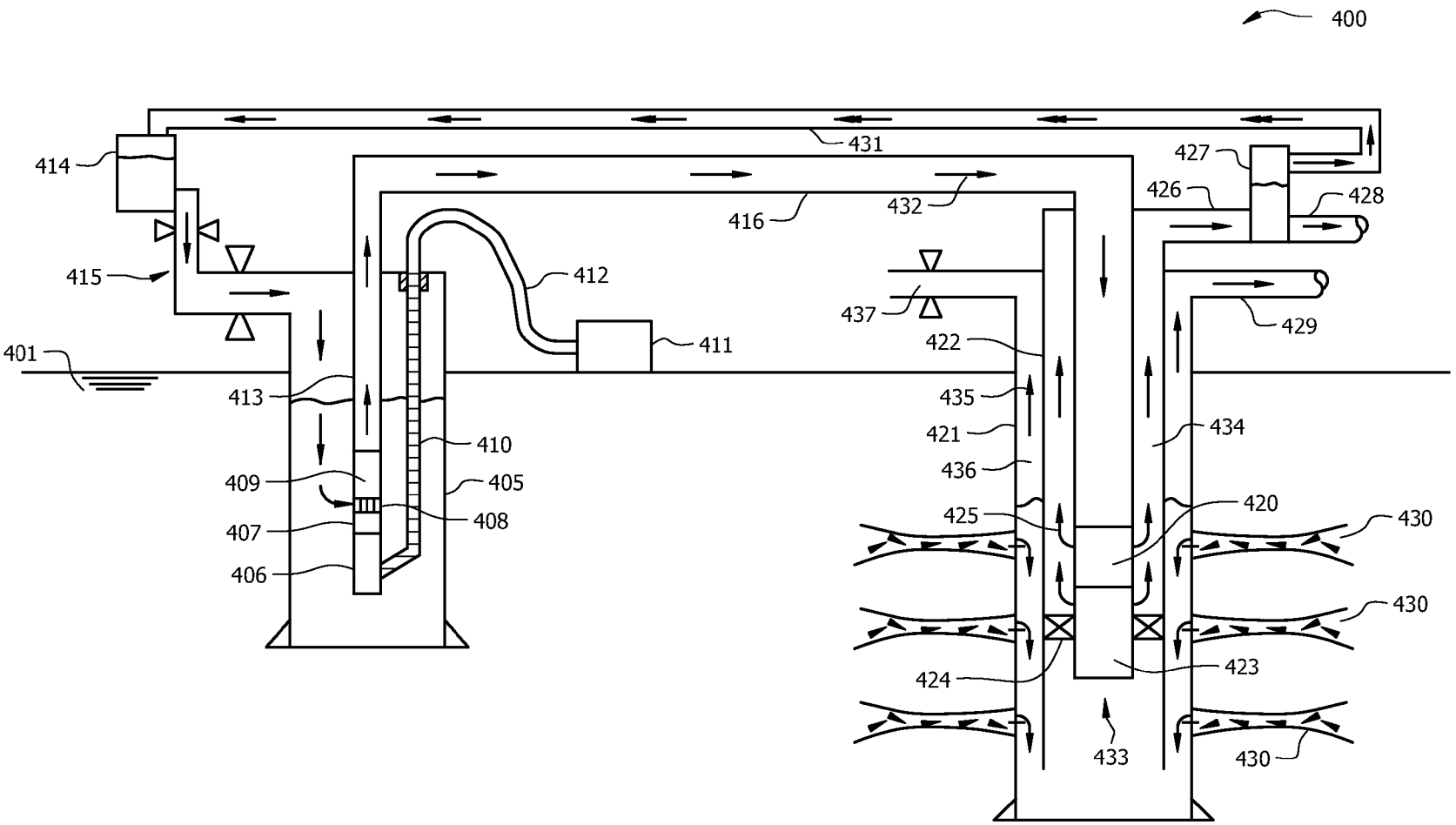
FIG. 4 illustrates an embodiment of a hydraulic fluid system of the present disclosure.

Referring to FIG. 4, one embodiment of the hydraulic fluid lifting system, system 400, of the present disclosure is shown. In particular, system 400 can incorporate the well configuration shown in FIG. 2 and the corresponding descriptions provided above. In one embodiment, the well configuration of FIG. 2 may be installed as shown in FIGS. 1 and 2. In another embodiment, the well configuration may be installed by other known methods. In FIG. 4, a caisson 405 is placed into the earth 401. The caisson 405 forms a closed sub-surface housing for the deployment of a submersible electrical motor 406, a submersible pump thrust bearing inside an electrical motor protector 407, a submersible pump intake 408, and a centrifugal pump 409. The electrical submersible motor 406 is connected to a submersible electrical cable 410, which is connected to an electrical power source 411 through a surface electrical power cable 412. Electrical power is conducted from the surface power source 411 through the surface electrical power line 412 down into the caisson 405 by the submersible power cable 410. The electricity powers the submersible electrical motor 406, which is connected to the submersible pump 409 by a common shaft. As such, the reciprocation, or movement, of the submersible electrical motor 406 results in the rotation of the centrifugal pump 409, which transforms electrical power into hydraulic power. Thus, operating submersible electrical motor 406 moves fluid from caison 405 through the pump 409 through conduit 413 and high pressure line 416 to well hydraulic engine 420. In particular, the pump 409 draws fluid through the submersible pump intake 408, and the fluid is transferred through the centrifugal pump 409 into the conduit 413. Fluid is supplied to the caisson 405 from a surface tank 414 through a surface conduit 415. Fluid is discharged from the submersible centrifugal pump 409 at high pressure that is sufficient to power a down hole hydraulic engine 420, which may correspond with engine 202 of FIG. 2.

As shown by FIG. 4, fluid is transferred from the caisson 405 to hydraulic engine 420 disposed in a production conduit 422, which is disposed in a well casing 421. The fluid is transferred through the submersible pump 409 up through the conduit 413 and surface high pressure line 416 down the well casing 421 and through a hydraulic conduit, or production conduit, 422, which is inserted coaxially within the well casing 421. Well casing 421 can be a casing in a gas well or other types of well such as oil or water. The hydraulic engine 420 and hydraulic pump 423 are attached to the distal end of hydraulic conduit 422. The suction and discharge of the submersible pump 423 are separated from one another by an elastomeric seal device 424, which is similar to seal means 206 described in FIG. 2. In this embodiment, the submersible hydraulic pump 423, which can correspond to hydraulic pump 203 of FIG. 2, in a well casing 421 is powered with power fluid 432 from centrifugal pump 409, which is located in a separate well. The pump 409 in caisson 405 can power submersible hydraulic pumps in a plurality of wells using known methods of pad drilling and completion techniques where many wells are drilled from a common surface pad location and the wells are deviated and terminated in different locations of a subterranean reservoir. The fluid 432 may include water and/or chemicals suitable to reduce friction and wear in the system as well as chemicals suitable to treat corrosion and scale formation. Examples of the fluid include propane, ammonia, water, oil, or any combination thereof.

FIG. 4 further depicts the submersible hydraulic pump 423 connected to hydraulic engine 420 and disposed inside the production conduit 422 where the well fluid 433 can be produced from subterranean reservoirs 430 through the pump 423. As shown, pump 423 draws the well fluid 433 through its intake and discharges well fluid 433 into the production conduit 422, which also has the exhausted power fluid 425 discharged from hydraulic engine 420. The well fluid 433 and power fluid 425 are mixed and produced to the surface conduit 426 and into a liquid/gas separator 427. The liquid/gas separator 427 separates gas from the mixture and directs the gas to line 428 for commercialization. The remaining fluid production is transferred through line 431 back to a storage tank of 414. Separator 427 may also be replaced by and/or include additional devices that separate other types of well fluids, such as hydrocarbon, from the mixture. The separated well fluids may be similarly directed to commercialization. A wide variety of filters, settling tanks, separation tanks, chemical injection pumps and fluids can be inserted in storage tank 414 to enhance the fluid properties being fed to the submersible pump 409. These enhancements include reducing solids, adding lubricants, corrosion inhibitors, oxygen scavengers, and scale inhibitors.

Referring to FIG. 4, fluids from the subterranean hydrocarbon reservoirs 430 that are not transferred to the surface through the annulus 434 between the outer diameter of the high pressure line 416 and inner diameter of the production conduit 422 are still allowed to flow up the well casing 421 to the surface. In particular, these fluids 435, such as gases from the reservoir, can flow through the annulus 436 between the outer diameter of production conduit 422 and inner diameter of well casing 421 to the surface and commercialized through surface line 437. As shown, it is clear to those familiar with the art of gas wells that the system 400 allows gas wells to be de-liquefied using the submersible hydraulic fluid pump 423 whilst producing and commercializing gas up the annulus 436 between the outer diameter of production conduit 422 and inner diameter of well casing 421.

The system 400 of FIG. 4 uses a hydraulic pump as an illustrative example of a fluid transducer powered by a submersible hydraulic engine to deliquify a gas well or to extract well fluids from gas wells, along with other types of wells. In other embodiments, however, other fluid transducer, such as compressors, can be used without departing from the spirit and scope of the embodiments of the present disclosure.

In other embodiments, the submersible hydraulic piston engine 420 and the submersible hydraulic piston pump 423 may be replaced with a jet pump. In yet another embodiment, the submersible hydraulic engine 420 may be replaced with a rotating hydraulic motor connected to a rotating submersible well fluid pump like a centrifugal pump or a progressive cavity pump.

As shown in FIG. 4, system 400 allows for the well fluid to be brought to the surface without the use of positive displacement pumps located at the surface. Additionally, system 400 provides housing for the hydraulic power supply system that protects the environment from any damages that may occur during the operation of the system 400.

Figure 5:
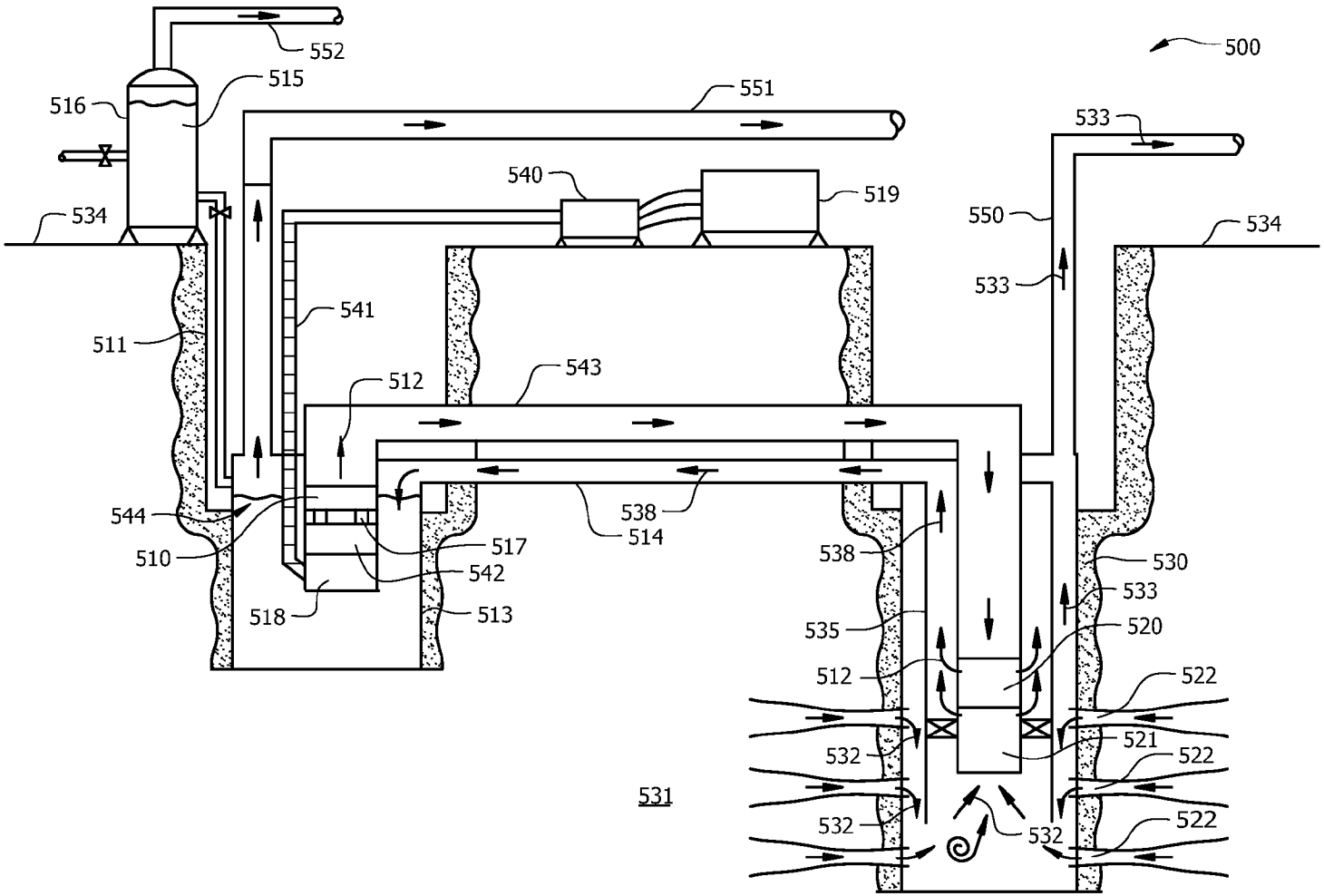
FIG. 5 illustrates another embodiment of a hydraulic power system of the present disclosure.

Referring to FIG. 5, another embodiment is depicted system 500, which can also incorporate the well configuration of FIG. 2 and the corresponding descriptions provided above. In one embodiment, the well configuration of FIG. 2 may be installed as shown in FIGS. 1 and 2. In FIG. 5, centrifugal pump 510 is located in subterranean enclosure 511. The centrifugal pump 510 pumps hydraulic power fluid 512 to a submersible hydraulic engine 520, which may correspond with engine 202 of FIG. 2, located in well 530, which is separate from subterranean enclosure 511. In other embodiments, there may be more than one well with a submersible hydraulic engine that is also powered by centrifugal pump 510. The submersible hydraulic engine 520 is connected by a shaft to a submersible hydraulic pump 521, which can correspond to hydraulic pump 203 of FIG. 2. This results in the reciprocation of the shaft of the hydraulic engine 520 driving the connected submersible hydraulic pump 521. The pump 521 draws well fluids like liquids 532 from reservoir 531 that is hydraulically communicated with the well 530 through perforations 522. Well fluids from reservoirs 531 may be separated into two streams: one stream of gas 533 that expands to surface 534 that may be collected and one stream of liquids 532. The well gases 533 are vented and transferred to one of conduits 550, 551, and 552 for commercialization. The well liquids 532 can be transferred to the surface through a production tubing 535 and combined with the exhausted power fluid 512 exiting the submersible hydraulic engine 520 forming a new combined liquid mixture 538. The combined liquid 538 of produced liquids 532 and exhausted power fluid 512 are transferred back to the casing 513 through an underground conduit 514. This subterranean transfer of fluids from well 530 to the subterranean casing 513 keeps the fluids from freezing in cold environments, and affords for a safer well location as all lines are underground where trucks, cranes, and people cannot damage them.

The process as depicted in FIG. 5 operates by first filling the casing 513 with transfer fluid 515 in process tank 516. Tank 516 is also used to accumulate and transfer fluids out of the system for commercialization, like condensate and oil. Likewise, it is used to remove from the process water produced from the well 530. It is clear to those familiar with oil and gas production that the process tank 516 can be manifolded with a plurality of tanks to allow for sustained operation such that the tanks are a buffer to the system keeping the centrifugal pump intake 517 flooded as well as storing produced well fluids from the system. The fluid from tank 516 is then connected to the casing 513 and level control devices are used on tank 516 as is well known to those familiar with the art of dump valves and separator fluid dump mechanisms to assure the fluid level in the casing 513 is above the centrifugal pump intake 517.

The submersible centrifugal pump 510 then pumps fluid 512 from casing 513 through a subterranean fluid conduit 543 to power the submersible hydraulic engine 520 thereby lifting liquids from the well 530 through a submersible pump 521 and transferring the well liquids 532 and hydraulic power fluids 512 back to the casing 513 and the submersible pump 510. The submersible electrical motor 518 can be powered with electricity from a generator 519. The speed of the submersible electrical motor 518 may be controlled by a frequency drive controller 540 and the electrical power is then transferred to the submersible electrical motor 518 through the electrical cable 541 and converted to shaft horsepower. The submersible electrical motor 518 shaft is connected to an electrical motor protector 542 by coupling the shafts of these two devices thereby transferring the shaft power through the electrical motor protector via a shaft that goes through the pump intake 517 to a shaft connection to the submersible centrifugal pump 510. Each of these four devices: the submersible electrical pump 518 the electrical motor protector 542, and the pump intake 517 and the submersible centrifugal pump can also be connected by flange and threaded connection into an assembly that is connected to a fluid conduit 543 and disposed inside the subterranean casing 513.

While not shown, other embodiments of FIGS. 4 and 5 may incorporate all or certain features of the configuration shown in FIG. 3, such as acoustic system. For instance, the controller device 315 may be connected to power source 411 of FIG. 4 or power source 519 of FIG. 5 to control the flow and pressure in fluid conduit 422 and 543, respectively, as described above to operate the hydraulic lifting system within desired parameters. Also, while the description may use gas as an example of a well fluid, it should be understood that the disclosed hydraulic lift system is similarly applicable to recover other well fluids such as hydrocarbon or water.

As shown, the apparatuses and methods of the present disclosure provide improved hydraulic power systems and acoustic controls to overcome the limitations of conventional lift systems, such as positive displacement pumps on the surface of the earth used to power submersible hydraulic motors, engines, turbines, pumps, compressors, and other submersible fluid transducers.

In particular, the present disclosure provides power fluid pumps, such as pump 409 of FIG. 4 and pump 510 of FIG. 5, that are non-piston pumps, non-positive displacement, pumps. In addition, the present disclosure provides placing the improved hydraulic powering pumps below the surface. The methods and apparatuses of the present disclosure apply to powering all submersible hydraulic transducer systems including compressors, and pumps and also have applications in water wells, in addition to oil and gas wells. The methods and apparatuses of the present disclosure can include submersible hydraulically driven piston pumps, progressive cavity pumps, centrifugal pumps, jet pumps, and other pumps that are used to lift well fluids from subterranean reservoirs. The present disclosure provides methods and apparatuses that address the limitation of using water in cold climates. In one embodiment, both the power fluid discharge, produced fluid, and fluid separation are kept below the surface to keep the fluid warm.

The present disclosure also provides for encapsulation of the improved hydraulic system by housing of the hydraulic power supply system within a caisson or a casing below the surface. The electrical submersible pump system is configured to discharge high pressure hydraulic power fluid to a well or a plurality of oil and gas production wells having submersible hydraulic fluid pumps disposed in them. The hydraulic power pumping system of the present disclosure powers submersible hydraulic motors, engines and pumps below the surface, thereby addressing safety, environmental, aesthetic, and cold temperatures limitations of conventional systems.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skilled in the art will readily appreciate from the disclosure of the present invention, processes, devices, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, devices, manufacture, compositions of matter, means, methods, or steps.

What is claimed is:

1. A submersible hydraulic lift system, comprising:

a first submersible pump assembly, wherein at least a portion of said first submersible pump assembly is located below the surface;

a first submersible hydraulic engine component connected to a first submersible hydraulic transducer component, wherein at least a portion of said first submersible hydraulic engine is located below the surface, said first submersible hydraulic transducer component having a hydraulic fluid connection with one or more fluids of a subterranean reservoir; and a first fluid path, said first fluid path hydraulically connecting said first submersible pump assembly with said first submersible engine component;

wherein said first submersible pump assembly is configured to hydraulically drive said first submersible hydraulic engine component by transferring power liquid from said first submersible pump assembly to said first submersible hydraulic engine component through said first fluid path, wherein said first submersible pump assembly comprises:

a submersible electrical motor component;

a submersible pump component; and a pump intake component, wherein said submersible pump intake component is connected to said electrical motor component and said submersible pump component, and wherein said submersible electrical motor component is connected to said submersible pump component where reciprocation of said submersible electrical motor component results in rotation of said submersible pump component.

2. The system of claim 1, further comprising:

a second fluid path, said second fluid path hydraulically connecting an output of said first fluid transducer component with the surface, wherein said hydraulically driven first submersible engine component is configured to drive said connected first submersible hydraulic transducer component; and wherein said driven first submersible hydraulic transducer component is configured to extract said one or more reservoir fluids and discharge said one or more reservoir fluids into said second fluid path.

3. The system of claim 2, further comprising a commercialization fluid path, said commercialization fluid path hydraulically connecting said second fluid path with a commercialization point.

4. The system of claim 2, wherein a portion of said first submersible pump assembly is disposed in a first casing of a first well and wherein a portion of said first submersible hydraulic engine component and a portion of said first submersible hydraulic transducer component are disposed in a second casing of a second well.

5. The system of claim 4, further comprising:

a second submersible hydraulic engine component connected to a second submersible hydraulic transducer component; wherein at least a portion of said second submersible hydraulic engine is located below the surface, said submersible hydraulic transducer component having a hydraulic fluid connection with one or more fluids of said subterranean reservoir;

a third fluid path, said third fluid path hydraulically connecting said first submersible pump assembly with said second submersible engine component;

wherein said first submersible pump assembly is configured to hydraulically drive said second submersible hydraulic engine component by transferring power liquid from said first submersible pump assembly to said second submersible hydraulic engine component through said third fluid path;

a fourth fluid path, said fourth fluid path hydraulically connecting an output of said second fluid transducer component with the surface; wherein said hydraulically driven second submersible engine component is configured to drive said connected second submersible hydraulic transducer component; and wherein said driven second submersible hydraulic transducer component is configured to extract said one or more reservoir fluids and discharge said one or more reservoir fluids into said second fluid path.

6. The system of claim 1, wherein said submersible pump component comprises a centrifugal pump.

7. The system of claim 1, wherein said fluid transducer comprises a submersible hydraulic pump.

8. The system of claim 1, wherein said fluid transducer comprises a submersible hydraulic compressor.

9. The system of claim 1, further comprising a frequency drive machine configured to control the revolutions per minute of said submersible electrical motor component.

10. The system of claim 1, further comprising an acoustic monitoring component, said acoustic monitoring component comprises:

at least one surface acoustic sensor connected to said first fluid path and to a controller component, said controller component connected to a power source of said first submersible pump assembly;

wherein said at least one surface acoustic sensor is configured to receive one or more acoustic signals generated by said first submersible hydraulic engine and transferred through said first fluid path;

wherein said at least one surface acoustic sensor is configured to transmit data to said surface controller data corresponding to said received one or more acoustic signals;

wherein said controller component is configured to manage at least the fluid discharge pressure and rate of said first submersible hydraulic engine by controlling said power source.

11. The system of claim 10, wherein said data is transmitted by a submersible acoustic signal transmission system connected to said at least one surface acoustic sensor and said controller component.

12. The system of claim 1, wherein said first fluid path comprises a subterranean conduit.

13. The system of claim 1, wherein said power liquid is selected from a group consisting of propane, ammonia, water, oil, and any combination thereof.

14. The system of claim 10, wherein said data is transmitted wirelessly.

15. A method for operating a submersible hydraulic engine comprising the steps of:

operating a first submersible pump assembly, wherein at least a portion of said first submersible pump assembly is located below the surface;

hydraulically driving a first submersible hydraulic engine component by said operation of said first submersible pump assembly, wherein at least a portion of said first submersible hydraulic engine is located below the surface in a well hydraulically connected to a subterranean reservoir, wherein said step of hydraulically driving comprises transferring a power fluid by said first submersible pump assembly from said first submersible pump assembly to said first submersible hydraulic engine component through a first fluid path, said first fluid path hydraulically connecting said first submersible pump assembly with said first submersible engine component; and driving a first submersible hydraulic transducer component connected to said first submersible hydraulic engine component by said hydraulically driving step, said first submersible hydraulic transducer component having a hydraulic fluid connection with one or more fluids of a subterranean reservoir;

discharging said power fluid into a return fluid path, said return fluid path hydraulically connecting an output of said first fluid transducer component with an input of said first submersible pump assembly;

extracting said one or more reservoir fluids by said first submersible fluid transducer; and discharging said one or more reservoir fluids by said first submersible fluid transducer into said return fluid path, wherein said power fluid mixes with said one or more reservoir fluids to create a fluid mixture and wherein at least a portion of said power fluid comprises a portion of said fluid mixture.

16. The method of claim 15, wherein said return fluid path hydraulically connects an output of said first fluid transducer component with said first submersible pump assembly through a surface facility.

17. The method of claim 16, further comprising the steps:

collecting at said surface facility said fluid mixture at the surface from an output of said return fluid path; and separating from said fluid mixture said one or more reservoir fluids by a separator component.

18. The method of claim 17, further comprising the step of:

transferring said separated one or more reservoir fluids from said surface facility to a commercialization point through a commercialization fluid path, said commercialization fluid path hydraulically connecting said return fluid path with a commercialization point.

19. The method of claim 16, further comprising the steps of:

monitoring one or more acoustic signals generated by said first submersible hydraulic engine with at least one surface acoustic sensor connected to said first fluid path and to a controller component, wherein said controller component is also connected to said power source of said first submersible pump assembly; and managing at least fluid discharge pressure and rate of said first submersible hydraulic engine by controlling said power source.

20. The method of claim 15, further comprising the steps of:

collecting said fluid mixture at a surface input facility at the surface from an output of a collection fluid path, said collection fluid path hydraulically connecting an output of said return fluid path with an input of a separator component; and separating from said fluid mixture said one or more reservoir fluids and an engine discharge fluid by said separator component.

21. The method of claim 16, further comprising the steps of:

collecting said one or more reservoir fluids from said well at the surface through a separate fluid path not hydraulically connected to said fluid transducer discharge; and conducting said produced fluid to a commercialization point.

22. The method of claim 15, wherein said return fluid path comprises a subterranean conduit.

* * * * *